US006141819A

United States Patent [19]

Driesen et al.

[11] Patent Number: 6,141,819

[45] Date of Patent: Nov. 7, 2000

[54] BRISTLE FOR A TOOTHBRUSH

[75] Inventors: Georges Driesen, Weilrod; Ahmet Cem Firatli, Wiesbaden; Rainer Hans, Idstein; Norbert Schaefer, Frankfurt; Armin Schwarz-Hartmann, Albig, all of Germany

[73] Assignee: Braun GmbH, Germany

[21] Appl. No.: 09/283,802

[22] Filed: Apr. 1, 1999

Related U.S. Application Data

[63] Continuation of application No. PCT/EP97/05221, Sep. 24, 1997.

[30] Foreign Application Priority Data

Oct. 2, 1996 [DE] Germany ..... 196 40 853

[51] Int. Cl.[7] ..... D02G 3/00

[52] U.S. Cl. ..... 15/207.2; 15/167.1; 300/21; 428/392; 428/397; 428/400

[58] Field of Search ..... 15/167.1, 207.2; 264/137; 156/148; 57/241, 250; 300/21; 428/357, 371, 370, 392, 397, 400

[56] References Cited

U.S. PATENT DOCUMENTS

| | | |
|---|---|---|
| 2,207,157 | 7/1940 | Neville et al. . |
| 2,434,533 | 1/1948 | Wurzburger . |
| 3,239,867 | 3/1966 | Charvat . |
| 3,505,163 | 4/1970 | Meers et al. . |
| 3,567,569 | 3/1971 | Terumichi et al. . |
| 3,969,090 | 7/1976 | Sasena et al. . |
| 4,498,708 | 2/1985 | Bromboz . |
| 4,534,080 | 8/1985 | Young et al. . |
| 4,756,044 | 7/1988 | Clark . |
| 4,762,750 | 8/1988 | Girgis et al. . |
| 5,133,590 | 7/1992 | Fitjer . |
| 5,220,774 | 6/1993 | Harbeke et al. . |
| 5,272,005 | 12/1993 | Collier et al. . |
| 5,409,740 | 4/1995 | Brann . |
| 5,533,227 | 7/1996 | Ito et al. . |
| 5,687,482 | 11/1997 | Behrendt . |
| 5,725,954 | 3/1998 | Montsinger . |
| 5,985,192 | 11/1999 | Weihrauch . |

FOREIGN PATENT DOCUMENTS

| | | |
|---|---|---|
| 531551 | 10/1956 | Canada . |
| 973159 | 2/1951 | France . |
| 906444 | 3/1954 | Germany . |
| 1 222 888 | 8/1966 | Germany . |
| 1 997 717 | 12/1968 | Germany . |
| 38 35 843 A1 | 4/1990 | Germany . |
| 233709 | 8/1994 | Japan . |
| 1077590 | 8/1967 | United Kingdom . |
| WO 97/10374 | 3/1997 | WIPO . |
| WO 97/25902 | 7/1997 | WIPO . |

OTHER PUBLICATIONS

Patent Abs. of Japan, vol. 16, No. 118, of JP 03–289906 (Ishikawa), pub'd Dec. 19, 1991.

Patent Abs. of Japan, vol. 95, No. 6, of JP 07–067724 (Shigeo), pub'd Mar. 14, 1995.

Patent Abs. of Japan, vol. 97, No. 10, of JP 09–140455 (Kunio), pub'd Jun. 3, 1997.

*Primary Examiner*—Terrence R. Till
*Assistant Examiner*—Jennifer McNeil
*Attorney, Agent, or Firm*—Edward S. Podszus

[57] ABSTRACT

The invention is directed to a bristle (12) for a toothbrush, in particular for an electric toothbrush, which is made of plastic and includes several filaments (13, 14, 15) joined together. The filaments (13, 14, 15) are wound or braided and joined together as a result of the action of chemical agents. This results in a firm bond between the filaments (13, 14, 15), and any cavities between the filaments (13, 14, 15) are reliably avoided. Overall, a toothbrush results which, in addition to having a high cleaning effect, offers bacteria or other germs no possibility of infiltration.

47 Claims, 3 Drawing Sheets

7

4
1
3
2
5

6
10
9
8
11
7

12
13
16
14
15
19
20
21
18
13
17
14
15
12

BRISTLE FOR A TOOTHBRUSH

This is a continuation of International Application No. PCT/EP97/05221, pending, with an International filing date of Sep. 24, 1997.

This invention relates to a bristle for a toothbrush, in particular for an electric toothbrush, which is made of plastic and includes several filaments joined together.

A bristle of this type is known from German Utility Model No. 19 97 717. This specification describes a toothbrush which has a plurality of bristles, each bristle being comprised of several filaments in an approximately parallel arrangement and welded thermally to one another. In this manner, the cleaning area formed by the free ends of the bristles is enlarged and hence the cleaning effect of the toothbrush increased. On the other hand, cavities involving the risk of being populated by bacteria or other germs are formed between the filaments.

From DE-PS 906444 there is known a method of manufacturing man-made bristles which are comprised of a plurality of individual filaments. These individual filaments are adhesively bonded to each other after exiting the spinning nozzles, with the bonding process being interrupted at intervals. Following fabrication of the adhesive bond, the bristle is cut to individual bristles in the non-bonded areas, with the individual bristle being fanned out at its tip. This method is rather elaborate, requiring the application of an adhesive to the filaments. In addition, interrupting the bonding process continuously at predetermined intervals is problematic.

From DE-AS 1 222 888 a brush is known having radially outwardly directed bristles attached to a hub. Each of the bristles has in its center a rigid core having at least one fiber of a vibration-damping material bonded thereto and helically wound around it in such fashion that only part of the core's surface is surrounded by the fiber.

SUMMARY OF THE INVENTION

It is an object of the present invention to further develop a bristle for a toothbrush of the type initially referred to, such that a high cleaning effect is guaranteed but cavities are eliminated.

This object is accomplished by the invention in that the filaments are wound or braided and chemically welded together as a result of the action of chemical agents.

The filaments lie in close proximity to each other as the result of winding or braiding the filaments, or generally as the result of stranding the filaments. The surface area of the filaments is then subjected to partial dissolving by means of chemical agents. In this manner, the filaments merge completely together and any cavities still remaining in the center of the wound or braided bristle are closed. This process can be supported by any existing or selectively variable tensile stress acting on the filaments. Altogether a cavity-free bristle is thus produced, offering bacteria or other germs no possibility of infiltration.

By using several filaments, however, the surface area of the toothbrush active in cleaning the teeth is at the same time enlarged, thereby improving the tooth cleaning action. Further, the surface area of the bristles is structured as a result of the winding or braiding operation, a fact that may be put to effective use during the cleaning of teeth. Both aspects are advantageous particularly with regard to the removal of plaque from the tooth surface.

In an advantageous embodiment of the bristle of the present invention, the free end of the bristle has a fanned arrangement. This fanned arrangement can be achieved by breaking open the joints of the individual filaments at the free end of the bristle. In this manner, individual thin tips are formed at the free end of the bristle, their number and diameter depending on the number and diameter of filaments in the bristle. These thin tips are able to penetrate the interproximal spaces far more easily and deeply, thereby improving the removal of plaque at these locations and thus improving the cleaning of teeth as a whole. Further, the surface area active in cleaning the teeth is further enlarged by the fanned arrangement, which in itself improves the cleaning of teeth.

In a further advantageous embodiment of the bristle of the present invention, the filaments of the bristle have different diameters. In this way it is possible to vary the mechanical properties, for example, rigidity or fatigue or resilience, of the individual bristles and hence of the toothbrush as a whole. Further, by appropriately selecting the diameters of the filaments, it is possible to also vary the winding or braiding of the individual bristles and hence the surface structure of the bristles. Both have a direct effect on the cleaning action and in particular on the cleaning comfort of the toothbrush.

In a preferred feature of the embodiment referred to, provision is made for one approximately central filament of preferably greater rigidity, which is surrounded by filaments of preferably less rigidity. The central filament serves preferably to stabilize the bristle, while the filaments surrounding this central filament are preferably intended to achieve a high cleaning effect and high cleaning comfort.

In an advantageous further configuration of the bristle of the present invention, the winding or braiding of the bristle follows a periodic pattern. This has advantages with regard to the manufacture of the bristle, in addition to resulting in a visually uniform appearance of the bristle and hence of the toothbrush as well.

The following values have proven to be especially suitable in particular for an electric toothbrush: three or four filaments per bristle are used, the diameter of the individual filaments lies between approximately 0.0762 mm and 0.127 mm, approximately, and the winding or braiding of a bristle is repeated after every 1.0 mm approximately to 3.0 mm, approximately.

According to a further advantageous embodiment of the present invention, the filaments are chemically welded together so firmly that in the area of the fanning a tear-growth resistance or peeling force of the filaments of between approximately 0.1 N and up to 0.15 N, preferably of 0.125 N results. This ensures that the bristles of the present invention fan out at their ends a small amount following the conventional, in particular mechanical rounding of an end section, for example, after the bristles are attached in a bristle carrier. Yet on the other hand, the tear-growth resistance is so high that further fanning out of the bristle into individual filaments is essentially prevented during normal use of the bristles, for example, as bristles of a toothbrush.

It has proven to be a particular advantage that amounts of 10% up to 50%, preferably 20% to 35%, of the cross-sectional area of the filaments are partially dissolved as a result of the action of the chemical agents. This reliably prevents the formation of cavities between the filaments. Furthermore, with such a degree of partial dissolution each of the filaments yet has an inner strength adequate to enable the chemical welding together of the filaments to form a bristle to be performed readily and continuously.

In cases in which filaments of a crystalline or part-crystalline material as, for example, polyamide, are employed, an outer envelope of the bristle has an amorphous structure following chemical welding of the filaments, whilst an inner core has an essentially crystalline structure.

In the center of the inner core there may then again be present an amorphous structure of the filament or bristle material.

In general the area of cross-section having the amorphous structure may amount to about 10% up to 50%, in particular 20% up to 30% of the total area of cross-section of the bristle. Correspondingly, the balance of the cross-sectional area has an essentially crystalline structure.

In an advantageous method of manufacturing a bristle according to the present invention, the filaments are wound or braided essentially without torsional stress and chemically welded together by the action of a solvent. Hence the winding or braiding operation is followed by joining of the filaments as a result of chemical agents. In this manner, a durable joint between the individual filaments is accomplished, while the mechanical properties of the filaments are substantially retained. The result is a composite filament structure which forms the bristle. Further, the partial dissolving of the filaments in a solvent ensures that any cavities, which may still exist, are reliably closed. Still further, the fixing operation referred to represents a simple and highly controllable method of processing the wound or braided filaments and joining them together to form a bristle.

In an advantageous further configuration of the method of the present invention, the filaments are wetted with a solvent for a period of between 5 s approximately and 50 s, approximately, preferably for between 20 s approximately and 30 s, approximately, where coated filaments are involved, for example. Highly concentrated formic acid has proven to be a particularly appropriate solvent for filaments made of polyamide.

An advantageous feature of the method of the present invention consists in fanning out the free end of the bristle by a mechanical process. The resulting thin tips are able to penetrate the interproximal spaces far more easily and deeply, thus improving the removal of plaque at these locations and hence the cleaning of teeth as a whole.

According to another highly advantageous further configuration of the present invention, during the process of chemical welding together the filaments are exposed to tensile stress of between approximately 6 MPa and up to 20 MPa, preferably 13 MPa. It is thereby ensured that the filaments which are wound or braided essentially without torsional stress are in relative contact with a sufficient force acting radially inwardly during chemical welding, with this radially inwardly acting force being generated by means of the tensile stress acting on the filaments.

In a particularly advantageous further configuration of the invention, the bristles of the present invention are used in the inner field of a preferably electrically powered round-head toothbrush (see FIGS. 6, 7).

Further features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summary in the claims and their back reference.

DETAILED DESCRIPTION OF PREFERRED EMBODIMENTS

Figures 1A, 1B, 1C, 2A, 2B, 3A, 3B, 4:
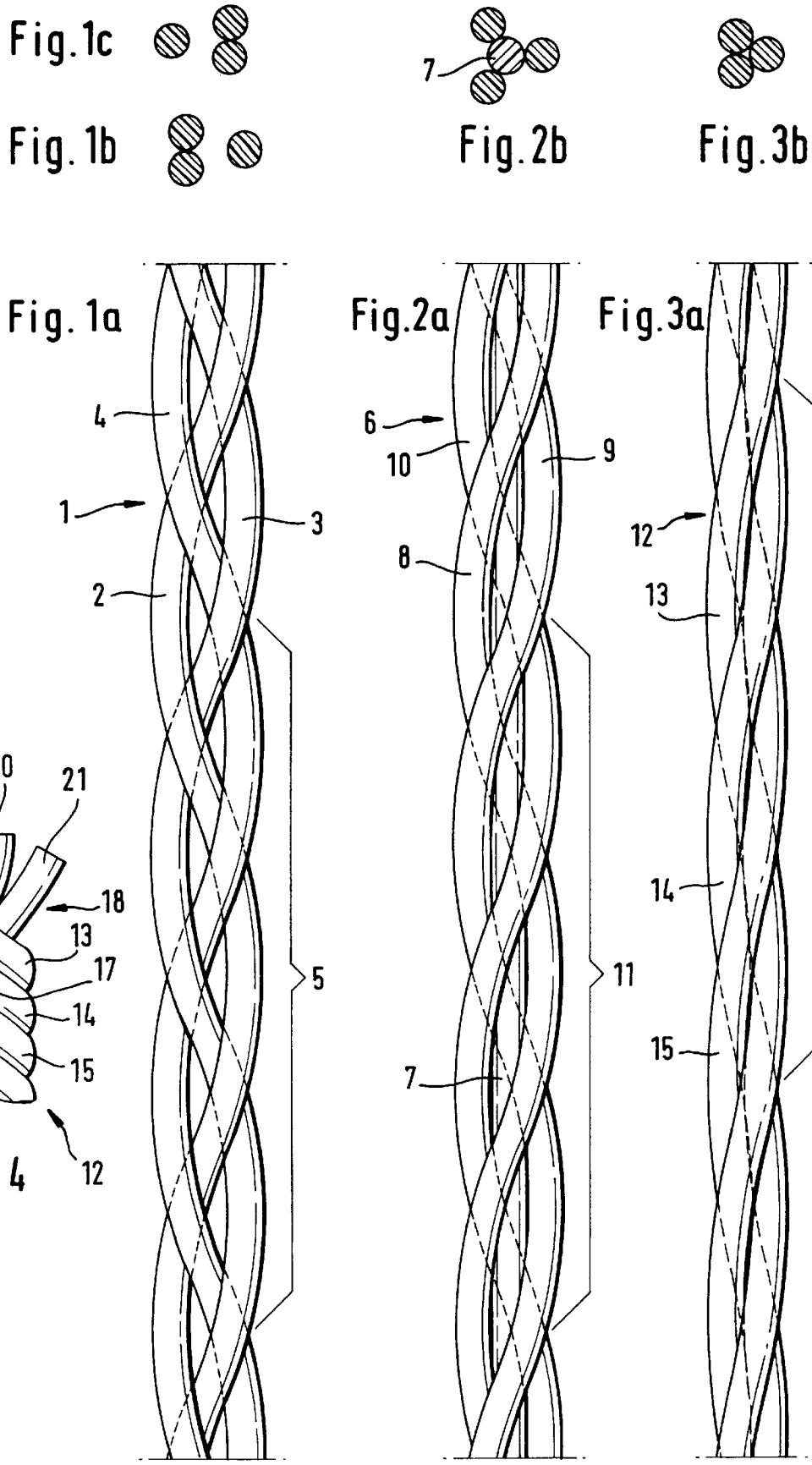
FIGS. 1*a* to 1*c* are a schematic view and two cross-sectional views of a toothbrush bristle constructed in accordance with the present invention, illustrating a first embodiment thereof.
FIGS. 2*a* and 2*b* are a schematic view and a cross-sectional view of a toothbrush bristle constructed in accordance with the present invention, illustrating a second embodiment thereof.
FIGS. 3*a* and 3*b* are a schematic view and a cross-sectional view of a toothbrush bristle constructed in accordance with the present invention, illustrating a third embodiment thereof.
FIG. 4 is a schematic view of the free end of the bristle of FIG. 3, illustrating a fanned arrangement.

FIGS. 1*a* to 1*c* show a bristle 1 which is comprises of three filaments 2, 3, 4. The filaments 2, 3, 4 are fabricated from the same plastic and have all the same diameter. The filaments 2, 3, 4 are braided, as becomes also apparent from the cross-sections of FIGS. 1*b* and 1*c*. The braiding is executed uniformly, which means that the braid and hence the surface structure of the bristle 1 is repeated at periodic intervals. This repeat is identified by reference numeral 5 in FIG. 1*a*.

FIGS. 2*a* and 2*b* show a bristle 6 which is comprised of four filaments 7, 8, 9, 10. Filament 7 is arranged centrally and is surrounded by the other filaments 8, 9, 10. Filament 7 is larger in diameter than filaments 8, 9, 10. Filaments 7, 8, 9, 10 are all made of plastic, with filaments 8, 9, 10 being made of the same plastic material, while the central filament 7 may be made of a different plastic material. Preferably, the central filament 7 has a high level of rigidity while the surrounding filaments 8, 9, 10 are less rigid. The different degrees of rigidity may be due to the filaments having different diameters and/or being fabricated from different plastics, for example, softer or harder plastics. The central filament 7 is enwound by the other filaments 8, 9, 10. The winding is executed uniformly, causing the winding and hence the surface structure of the bristle 6 to be repeated at periodic intervals. This repeat is identified by reference numeral 11 in FIG. 2*a*.

FIGS. 3*a* and 3*b* show a bristle 12 which is comprised of three filaments 13, 14, 15. The filaments 13, 14, 15 are made of the same plastic and have all the same diameter. The filaments 13, 14, 15 are wound. The winding is executed uniformly, causing the winding and hence the surface structure of the bristle 12 to be repeated at periodic intervals. This repeat is identified by reference numeral 16 in FIG. 3*a*.

The filaments designated 2, 3, 4, 7, 8, 9, 10, 13, 14, 15 of the bristles 1, 6, 12 of FIGS. 1*a* to 1*c*, 2*a* and 2*b* as well as 3*a* and 3*b* may be made of polyamide, polyester or polypropylene. The diameter of the identified filaments may amount to between 0.0762 mm (3 mils) approximately and 0.127 mm (5 mils), approximately. The repeat 5, 11, 16 of the braiding or winding of the filaments referred to may have a value of between 1.0 mm approximately and 3.0 mm, approximately. As will be explained in the following, the individual filaments 2, 3, 4, 7, 8, 9, 10, 13, 14, 15 of the bristles 1, 6, 12 are joined securely together.

FIG. 4 shows a free end 17 of the bristle 12 of FIGS. 3*a* and 3*b*. The free end 17 displays a fanned arrangement 18.

This means that the free ends 19, 20, 21 of the filaments 13, 14, 15, respectively, are not joined together but project from the free end 17 of the bristle 12 as individual tips. The length of the fanned arrangement 18 is selected so that the projecting tips are inclined to penetrate a user's interproximal spaces.

The described fanned arrangement of the free end of the bristle may also exist accordingly on the bristles of FIGS. 1*a* to 1*c* and/or FIGS. 2*a* and 2*b*.

To manufacture the bristles 1, 6, 12, the filaments 2, 3 4, 7, 8, 9, 10, 13, 14, 15 are braided or wound or generally stranded. It is possible to perform the winding or braiding operation with prior stretched filaments 2, 3, 4, 7, 8, 9, 10, 13, 14, 15, which already have the required mechanical properties.

The braided or wound filaments 2, 3, 4, 7, 8, 9, 10, 13, 14, 15 are then dipped in a solvent where they are fixed by partial dissolving. The dwell time in the solvent amounts to a period of between 5 s approximately and 50 s, approximately. Phenol, M-cresol or formic acid may be used as solvents for filaments made of polyamide, for example. With coated filaments a period of between 20 s approximately and 30 s, approximately, has proven to be advantageous when using highly concentrated formic acid. By wetting the filaments 2, 3, 4, 7, 8, 9, 10, 13, 14, 15 with the solvent, a firm bond is established between the joints of the filaments 2, 3, 4, 7, 8, 9, 10, 13, 14, 15.

The solvent is then neutralized with water or other suitable media, or the surplus solvent is removed. The filaments 2, 3, 4, 7, 8, 9, 10, 13, 14, 15 are then dried. The resultant bristle 1, 6, 12 can then be further processed in the known manner.

To produce the fanned arrangement 18 at the free end 17 of the bristle 12, this particular free end 17 is processed mechanically in a subsequent operation. This mechanical operation may involve, for example, a grinding operation or the like or some other impact operation performed on the free end 17. In whichever case the firm bond between the filaments 13, 14, 15 of the bristle 12 produced by the chemical fixing is broken up again in the area of the free end 17 of the bristle 12 by the mechanical operation. As a result, the free ends 19, 20, 21 of the filaments 13, 14, 15 are produced, with the length of the free ends 19, 20, 21 and hence the length of the fanned arrangement 18 depending on the degree of the mechanical operation performed on the free end 17 of the bristle 12. The chemical fixing of the filaments 13, 14, 15 is executed in such a way as to enable the breaking up of the firm bond at the free end 17 of the bristle 12 on the one hand, but to prevent any breaking up of the firm bond between the filaments 13, 14, 15 by normal use of the bristle on the other hand.

Figure 5:
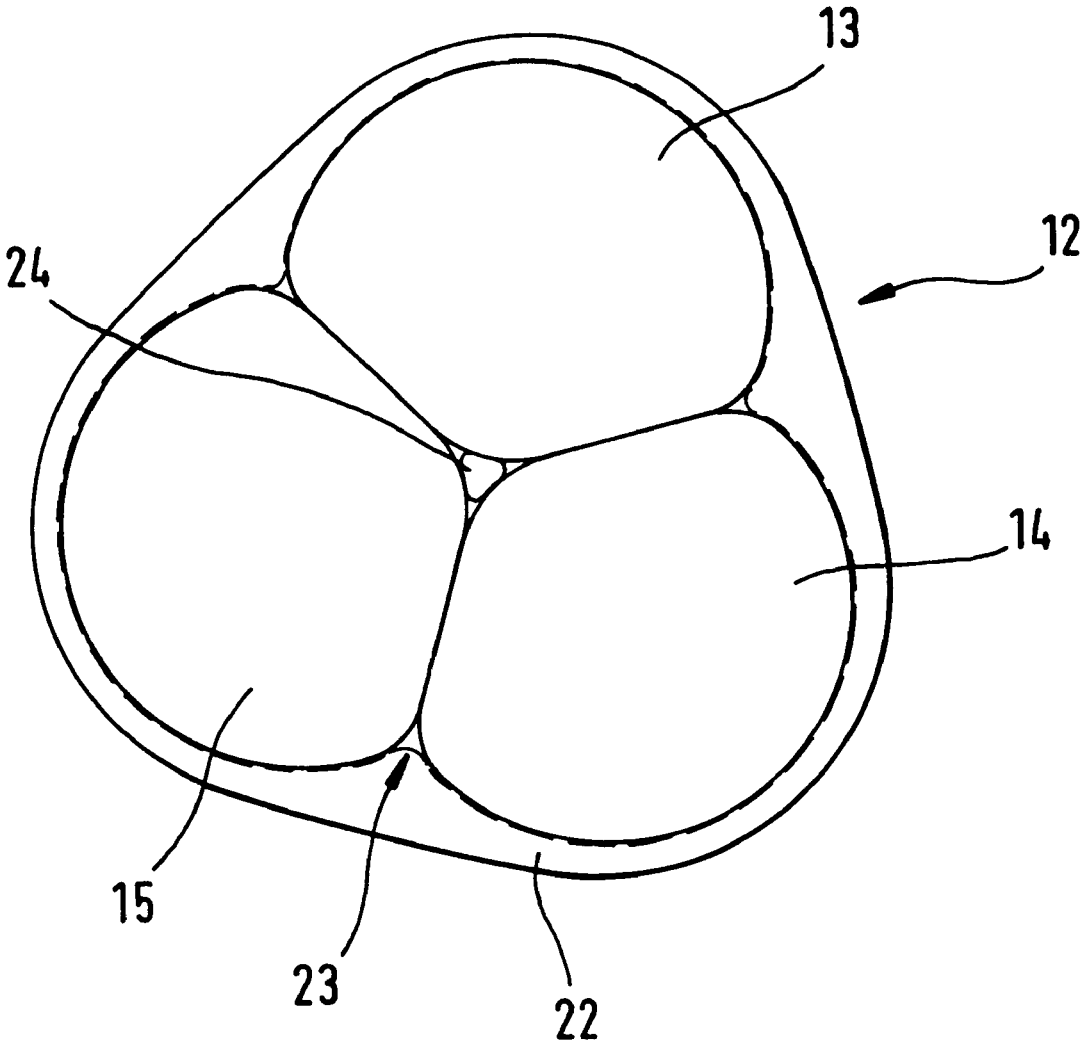
FIG. 5 is a cross-sectional view, in detail and on an enlarged scale, of a bristle of FIG. 3*b;*

As becomes apparent from FIG. 5, the chemical bonding of the filaments 13, 14, 15 made from part-crystalline material results in a particular cross-sectional structure of the bristle 12. An outer envelope 22 of the bristle 12 has an essentially amorphous structure which is attributable to the partial dissolving of the outer envelope of the individual filaments 13, 14, 15 by the solvent. The inner core 23 of the bristle 12 possesses an essentially crystalline structure, said inner core 23 being formed substantially by the cores of the filaments 13, 14, 15 which were not subjected to the partial dissolving action. In the center 24 of the inner core there may be a small area of cross section with an amorphous structure. Filaments 13, 14, 15 welded together chemically in such manner possess an amorphous structure amounting to about 10% to 50%, in particular 20% to 30% of the total area of cross-section. Accordingly, about 90% to 50%, in particular 80% to 70%, of the cross-sectional area are essentially crystalline.

It proves to be particularly advantageous for the filaments to be in a condition nearly or essentially free from torsional stress following winding, braiding or stranding. This is ensured in that during the operations of braiding, winding or stranding each of the filaments 2, 3, 4; 7, 8, 9, 10; 13, 14, 15 is rotated about its own axis in a direction opposite to the direction of rotation necessary for stranding, braiding or winding, so that torsional stresses are substantially avoided. Coiling of the filament composite prior to chemical welding and subsequent to stranding, braiding or winding is thus precluded. Evidence of this essentially torsion-free state can be furnished following welding by microtome cuts and analyzing the sections under polarized light. To ensure an optimal chemical welding together of the filaments 2, 3, 4; 7, 8, 9, 10; 13, 14, 15, fixing is performed under tensile stresses of between about 6 MPa and up to 20 MPa, preferably of about 13 MPa. Fixing is accomplished by the action of chemical agents which are however washed out leaving practically no residues or reaction products in the filament composite. The fixing period is selected such that amounts of between 10% and up to 50%, preferably between 20% and up to 35% of the cross-sectional area of the individual filament are partially dissolved. For filaments 2, 3, 4; 7, 8, 9, 10; 13, 14, 15 without surface coating the fixing period is in the range of between 5 sec and 20 sec or at around 10 sec. In cases in which filaments with a silicone coating are utilized, fixing periods of between 20 sec and 40 sec, preferably of between 25 sec and 30 sec, may be contemplated. Such a silicone coating enhances the sliding behavior of the filaments during manufacture. The bonding strength can be determined by measuring the peeling forces and the wear of the bristle 1, 6, 12. To ensure fanning out of the multifilament ends during the mechanical rounding operation, for example, the process parameters have to be set such that the peeling forces are in the range from 0.1 N up to about 0.15 N.

The fixing periods indicated above vary, of course, in dependence upon the process parameters and apply in particular for the special case in which concentrated formic acid is used as solvent at a temperature of about 20° C., with the filaments being made of polyamide (PA6.12) and having a diameter ranging from about 0.076 mm up to 0.126 mm.

By the processes of winding, braiding or stranding the filaments, the individual filaments are brought in close relative contact. The tensile force acting on the filament composite produces a resultant force in the direction of the center 24 of the bristle 1, 6, 12. Due to the action of the chemical agents or solvents, the surface of the filaments 2, 3, 4; 7, 8, 9, 10; 13, 14, 15 is partially dissolved, producing a doughy state. In the process, the secondary valency forces effecting the confinement of the substances are diminished by the solvent, without practically attacking or destroying the covalent bonds. This state enables the diffusing of molecular segments over the interfaces into the neighboring component. In this process, the penetration depth of the molecular chains is dependent on the degree of partial dissolution and the amount of tensile stress, and it exerts an effect on the bond strength of the overall system. The bond in turn is based on the secondary valency forces of the atoms of neighboring molecular chains which unfold fully again after the solvent is washed out subsequently.

For the purposes of this application, chemical welding is understood to mean a joining of the filaments by partial dissolving of the surface of the filaments by means of a chemical solvent. By contrast, in a thermal welding process the surface of the filaments is softened by the action of heat. Where filaments are joined together by adhesive bonding, an additional substance is permanently applied to the filament surface to join the filaments together.

Figure 6:
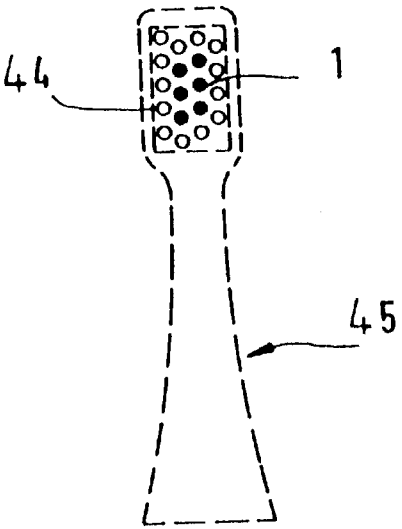
FIG. 6 is a schematic view of a field of bristles of FIG. 1 on a toothbrush head.
Figure 7:
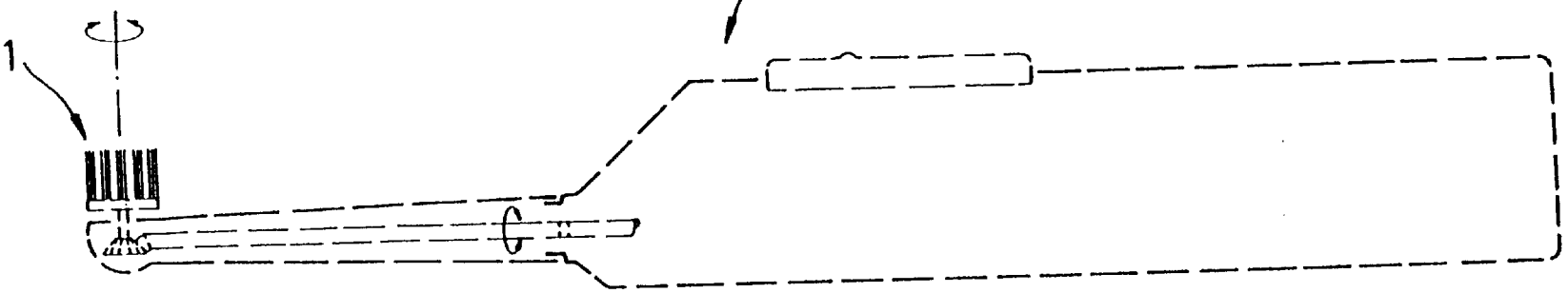
FIG. 7 is a schematic view of a field of bristles of FIG. 1 on a rotary bristle head.

The described bristles 1, 6, 12 of FIGS. 1*a* to 1*c*, 2*a* and 2*b* as well as 3*a* and 3*b* are intended for use, as illustrated in FIG. 6 and FIG. 7, in toothbrushes 45, particularly for use in electric toothbrushes 46. FIG. 6 shows a field 44 of bristles on the toothbrush's bristle head. The described bristles 1, 6, 12 may be used particularly advantageously in the inner field of a round-head tooth brush.

What is claimed is:

1. A bristle for a toothbrush, comprising a plurality of plastic filaments each having a cross-sectional area defining a core region and a peripheral region, at least one filament of said plurality being wound or interlaced about an other said filament of said plurality and defining an interface between said filaments, and said at least one and said other filaments being chemically welded, wherein respective said peripheral regions of adjacent said chemically welded filaments have an at least partially dissolved structure and said chemically welded filaments have a fixed bond along the interface.

2. The bristle according to claim 1, wherein said plurality of filaments are between two and eight in number.

3. The bristle according to claim 2, wherein said plurality of filaments are between three and four in number.

4. The bristle according to claim 1, wherein a first said filament has a different thickness than a second said filament.

5. The bristle according to claim 1, wherein said filaments have thickness between about 0.0508 mm and about 0.254 mm.

6. The bristle according to claim 5, wherein said thickness is between about 0.0762 mm and about 0.127 mm.

7. The bristle according to claim 1, wherein said other filament is disposed generally centrally surrounded by said at least one filament and has a greater rigidity than said at least one filament.

8. The bristle according to claim 1, wherein winding or interlacing of the filaments within said plurality of filaments follows a periodic pattern.

9. The bristle according to claim 8, wherein the periodic pattern repeats in an interval of between about 0.5 mm and about 5.0 mm.

10. The bristle according to claim 9, wherein said interval is between about 1.0 mm and about 3.0 mm.

11. The bristle according to claim 1, wherein the filaments comprise a material selected from a group of materials consisting of a polyamide, a polyester and a polypropylene.

12. The bristle according to claim 1, wherein a region of between about 10% and 50% of said cross-sectional area of the filaments is partially dissolved by the welding.

13. The bristle according to claim 12, wherein said region is between 20% and 30%.

14. The bristle according to claim 1, wherein there are at least three said filaments, said filaments being braided.

15. The bristle according to claim 1, wherein the welded interface in a region of a free end of the bristle is severed and the free end of the bristle has a fanned arrangement.

16. The bristle according to claim 1, wherein said at least partially dissolved peripheral region has a different molecular structure than said respective core region.

17. The bristle according to claim 1, in combination with the toothbrush.

18. The bristle and toothbrush combination of claim 17, further comprising a plurality of bristles mounted on a bristle mounting portion of the toothbrush, said bristle mounting portion adapted to be electromotively driven.

19. The bristle and toothbrush combination of claim 18, wherein the plurality of bristles is disposed on an inner region of the bristle mounting portion.

20. A bristle for a toothbrush, comprising a plurality of plastic filaments, at least one filament of said plurality being wound or interlaced about an other said filament of said plurality, said at least one and said other filaments being chemically welded so as to form a bond along an interface between said filaments, and wherein a free end of the bristle has a fanned arrangement.

21. The bristle according to claim 20, wherein a tear-growth resistance of the fanned arrangement is between about 0.1 N and about 0.15 N.

22. The bristle according to claim 21, wherein said tear-growth resistance is about 0.125 N.

23. A bristle for a toothbrush, comprising a plurality of plastic filaments, at least one filament of said plurality being wound or interlaced about an other said filament of said plurality, said at least one and said other filaments being chemically welded, and wherein a peeling force of the filaments is between about 0.1 N and about 0.15 N.

24. The bristle according to claim 23, wherein said peeling force is about 0.125 N.

25. A bristle for a toothbrush, comprising a plurality of plastic filaments, at least one filament of said plurality being wound or interlaced about an other said filament of said plurality, said at least one and said other filaments being chemically welded, and wherein at least a portion of the plurality of filaments comprises an at least partially crystalline structure, and further defining an envelope region having a generally amorphous structure being disposed outward of a core region having at least partially crystalline structure.

26. The bristle according to claim 25, wherein said core region further comprises an inner region having generally amorphous structure.

27. The bristle according to claim 25, wherein an amount of between about 10% and about 50% of a cross-sectional area of the bristle has the amorphous structure.

28. The bristle according to claim 27, wherein said amount is between 20% and 30%.

29. A method of forming a bristle for a toothbrush, comprising the steps of providing a plurality of plastic filaments, entwining, substantially free of torsional stress, at least first and second ones of said filaments, dissolving at least partially the entwined first and second filaments with a solvent to chemically weld said first and second filaments.

30. The method of claim 29, wherein said step of entwining comprises winding.

31. The method of claim 29, wherein said step of entwining comprises braiding at least first, second and third ones of said filaments.

32. The method of claim 29, further comprising the step of wetting the filaments with a solvent for a time of between about 5 sec and about 50 sec sufficient to react with a surface coating of said filaments.

33. The method of claim 32, wherein said step of wetting is for a duration between about 5 sec and 15 sec.

34. The method of claim 32, wherein said step of wetting is for a duration between about 20 sec and 30 sec.

35. The method of claim 29, wherein said step of dissolving comprises using the solvent selected from a group of solvents consisting of phenol, M-cresol and formic acid.

36. The method of claim 29, further comprising the step of mechanically separating the welded filaments, at a distal free end thereof, into a fanned arrangement.

37. The method of claim 29, further comprising the step of tensioning said filaments while performing said step of chemically welding.

38. The method of claim 37, wherein during said step of tensioning comprises applying tensile stress between about 6 MPa and about 20 MPa to the filaments.

39. The method of claim 38, wherein the filaments are stressed about 13 MPa.

40. A bristle for a toothbrush, comprising a plurality of plastic filaments extending between a bristle proximal end and a bristle distal end, at least a first filament of said plurality being entwined about at least a second filament of said plurality, and a substantially continuous envelope region formed by portions of said first and said second entwined filaments being chemically welded, said envelope region being disposed on radially outward surfaces of said filaments and extending between the bristle proximal and distal ends.

41. The bristle according to claim 40, wherein said at least first filament is wound about said at least second filament.

42. The bristle according to claim 40, wherein at least first, second and third said filaments are braided.

43. The bristle according to claim 40, wherein said plurality of filaments are at least three in number.

44. The bristle according to claim 40, wherein said envelope region has a generally amorphous structure.

45. The bristle according to claim 40, wherein the filaments in a region of the bristle distal end are splayed.

46. The bristle according to claim 40, wherein a portion of the envelope region is disposed at a generally central inner region of a cross-sectional area of the bristle.

47. The bristle according to claim 40, wherein said filaments have thickness of less than about 0.254 mm.

* * * * *